US006179727B1

(12) United States Patent
Giordano

(10) Patent No.: US 6,179,727 B1
(45) Date of Patent: Jan. 30, 2001

(54) DUAL RADIUS PUTTER

(76) Inventor: Louis J. Giordano, 925 S. Spring St., Springfield, IL (US) 62704

( * ) Notice: Under 35 U.S.C. 154(b), the term of this patent shall be extended for 0 days.

(21) Appl. No.: 09/187,841

(22) Filed: Nov. 6, 1998

(51) Int. Cl.[7] ..... A63B 53/04
(52) U.S. Cl. ..... 473/330; 473/341; 473/342
(58) Field of Search ..... 473/330, 331, 473/324, 340, 251, 313, 341, 342; D21/736–746

(56) References Cited

U.S. PATENT DOCUMENTS

| | | | |
|---|---|---|---|
| D. 388,852 | | 1/1998 | Giordano . |
| 1,525,137 | * | 2/1925 | Lawton . |
| 1,666,174 | | 4/1928 | Holland . |
| 2,023,885 | * | 12/1935 | Hinckley . |
| 2,472,312 | | 6/1949 | Parrish . |
| 3,172,667 | | 3/1965 | Baker et al. . |
| 3,394,937 | | 7/1968 | Allport . |
| 3,989,257 | * | 11/1976 | Barr . |
| 4,023,802 | | 5/1977 | Jepson et al. . |
| 4,077,633 | * | 3/1978 | Studen . |
| 4,162,074 | * | 7/1979 | Thomson . |
| 4,722,528 | | 2/1988 | Tsao . |
| 4,795,158 | | 1/1989 | Kuykendall . |
| 4,881,737 | | 11/1989 | Mullins . |
| 4,902,015 | * | 2/1990 | Nebbia . |
| 4,915,385 | | 4/1990 | Anderson . |
| 4,927,144 | | 5/1990 | Stormon . |
| 5,193,806 | | 3/1993 | Burkly . |
| 5,253,869 | | 10/1993 | Dingle et al. . |
| 5,286,027 | | 2/1994 | Koumarianos . |
| 5,310,185 | | 5/1994 | Viollas et al. . |
| 5,346,216 | | 9/1994 | Aizawa . |
| 5,348,301 | | 9/1994 | Ma . |
| 5,354,060 | | 10/1994 | Wooton . |
| 5,382,019 | * | 1/1995 | Sneed . |
| 5,388,827 | | 2/1995 | Reynolds, Jr. . |
| 5,447,310 | | 9/1995 | Jernigan . |
| 5,716,290 | | 2/1998 | Baker et al. . |
| 5,718,644 | | 2/1998 | Donofrio . |
| 5,863,262 | * | 1/1999 | Donofrio . |

FOREIGN PATENT DOCUMENTS

| | | |
|---|---|---|
| 652592 | 12/1848 | (GB) . |

* cited by examiner

*Primary Examiner*—Sebastiano Passaniti
(74) *Attorney, Agent, or Firm*—Jenner & Block

(57) ABSTRACT

Several embodiments of a golf club putter having a novel putter head with a striking face defined by two unequal radii are disclosed. In one embodiment, the convex striking face is defined by an upper radius and a lower radius meeting along a linear path to provide an single point of contact for the engagement of a golf ball. In a second embodiment, the upper radius and lower radius meet along an arcuate path, and a protruding bottom surface mimics this arcuate path, to provide an optimum point of contact for a golf ball regardless of the longitudinal angle of address of the putter. Dual radius putters having weighting schemes and composite or plastic inserts are also disclosed to further improve the true roll of a golf ball generated by an engagement with the instant putter.

15 Claims, 3 Drawing Sheets

DUAL RADIUS PUTTER

BACKGROUND OF THE INVENTION

I. Field of the Invention

This invention relates generally to a club type instrument for striking a ball and more particularly to a golf club for putting a golf ball.

II. Prior Art

Golf club putters (hereinafter "putters") of various types are known. Such putters are designed for striking a golf ball along substantially smooth grass portions of golf courses. Since putting often accounts for nearly half of a golfer's total strokes, many specialized types of putters have been disclosed. As the golfer's aim is to minimize the number of strokes, many specialized putters have been designed to maximize the efficiency and accuracy with which a golf club putter engages a golf ball.

Putters with various weighting schemes are known to those skilled in the art. Moreover, putters having substantially rounded engagement surfaces have similarly been disclosed. It is also known to provide a composite insert on the striking face of the putter to give the golf ball a soft feel at the time of engagement.

However, none of the aforementioned inventions or improvements have been done in combination. Moreover, little attention has been paid to the overall geometry of the club face and its optimization. For instance, while a putter with a substantially rounded striking face has been disclosed, its simple club face does not geometrically assure the optimum engagement of a golf ball. Therefore, the need exists to provide a golf club putter having a geometrically optimized club face and also having all of the above-described features.

SUMMARY OF THE INVENTION

Briefly described, the present invention comprises a putter including a shaft connected to a uniquely designed putter head. This unique putter head provides a geometrically optimized convex striking surface which ensures a single point of contact when striking a golf ball.

While arounded-face teardrop style putter was disclosed in U.S. Pat. No. 5,354,060 to Wooten ("Wooten"), the Wooten club face does not ensure that a single point of contact will engage a golf ball when struck. The present invention improves upon Wooten by providing a dual radius convex face. In this way the upper portion of the striking surface of the club face has a smaller radius of curvature than the lower portion of the striking club face. Therefore, the intersection of these two radii provides for a single point of contact for a golf ball. Further, the larger radius of curvature on the lower portion of the club striking face ensures that the striking face will disengage the ball as putted more quickly than the putter taught by Wooten. Hence, the golf ball as engaged will not be hampered by unwanted spins provided by the club face. As it is known to those skilled in the art, a golf ball rolls more predictably when struck quickly and by a single point of a striking club. Furthermore, the advantage of a single point of contact is that the ball will tend not to skid before eventually rolling when engaged by the club.

Another problem with the prior art putters is that they do nothing to ensure a single point of contact with a golf ball when the putter itself is not in proper longitudinal and/or angular alignment with respect to the ball and the ground. In a preferred embodiment of the present invention, the bottom surface of the putter is curved as defined by a bottom radius. Likewise, the intersection of the two radii of the club face is curved as defined by a path radius. To optimize the geometry of the club face, the path radius and bottom radius are complementary. Thus, no matter what the orientation angle of the putter during the engagement of the ball, a single point of contact will be ensured.

It is therefore an object of the present invention to provide a new putter that ensures a single point of contact with a golf ball.

Another object of the present invention is to provide a putter with a unique putter head having a convex striking face and bottom surface area to ensure a single point of contact with a golf ball when struck.

Still another object of the present invention is to provide a putter with all the aforementioned characteristics and a weighting scheme which places weights at the same level as the point of engagement of the golf ball.

Still another object of the present invention is to provide a putter with all the aforementioned features and a composite insert to provide a soft point of engagement for a golf ball.

Yet another object of the invention is to provide a putter with the aforementioned features which confirms to the United States Golf Association's Rules of Golf.

These and other advantages of the present invention will become apparent upon consideration of the following detailed description taken in conjunction with the accompanying drawings.

DETAILED DESCRIPTION OF THE PREFERRED EMBODIMENTS

Figure 1:
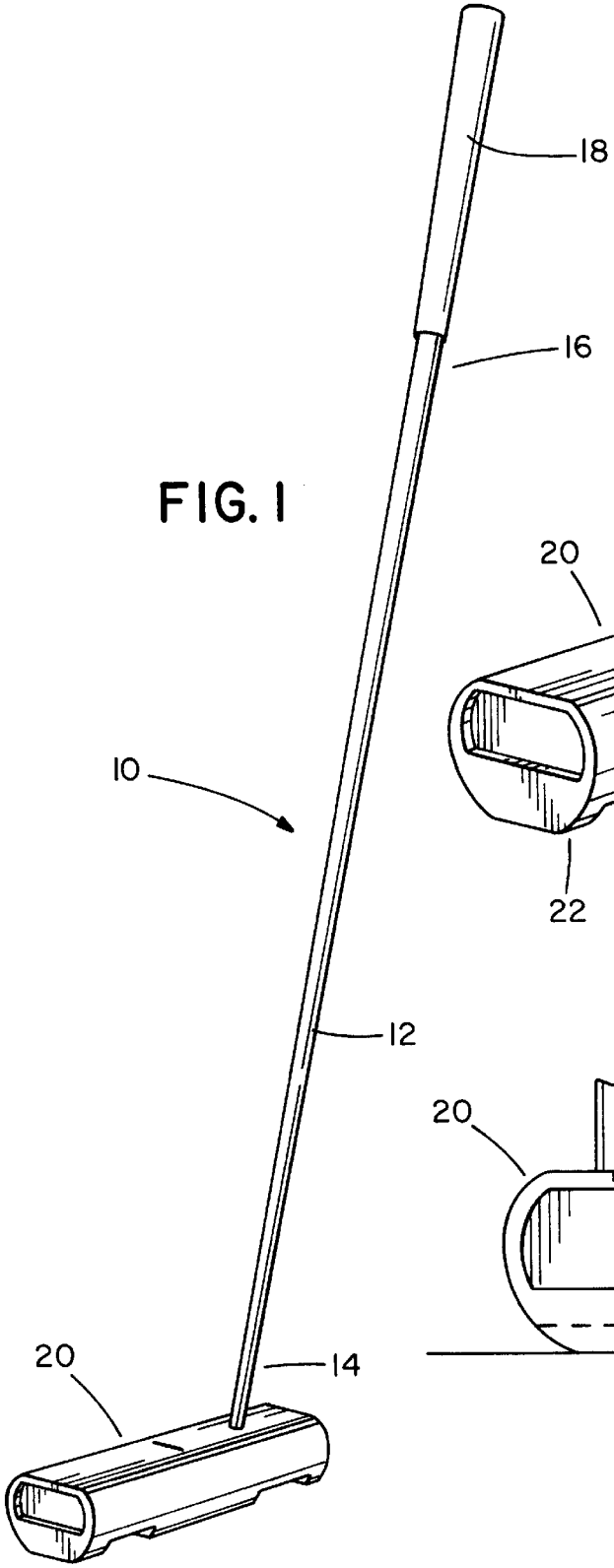
FIG. 1 is a perspective view of the dual radius putter.

Referring now in greater detail to the drawings, in which like numerals represent like components throughout the several views, FIG. 1 shows a perspective view of the dual radius putter. Putter 10 is comprised of a shaft 12, having a mounting end 14 and a handle end 16. A handle 18 is operatively disposed on handle end 16 of shaft 12. A putter head 20 is fixably disposed on mounting end 14 of shaft 12.

Figure 2:
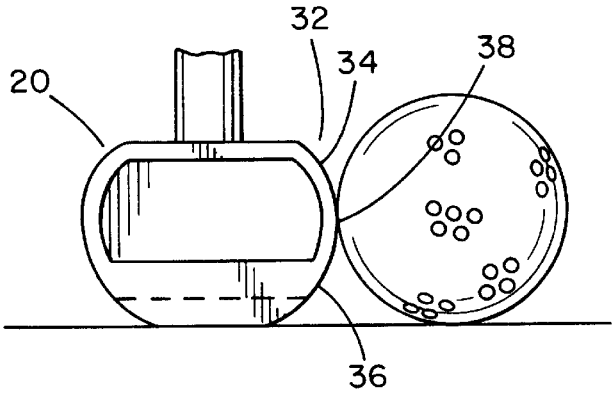
FIG. 2 is an end view of the putter showing the position of the putter head vis à vis a golf ball.

FIG. 2 shows an end view of putter head 20. Front surface 32 is provided for striking a golf ball and comprises a convex surface defined by upper radius 34 and lower radius 36. In this preferred embodiment upper radius 34 is smaller than lower radius 36 (for example, 0.5 inches and 0.75 inches, respectively). At the intersection of upper radius 34 and lower radius 36 is linear path 38. When a golf ball is engaged by putter head 20, a single point of contact will eventuate along linear path 38. Of great importance, the differences in the radii ensure that the golf ball will be given a true roll and will not skid across the green when engaged by putter head 20.

Figure 3:
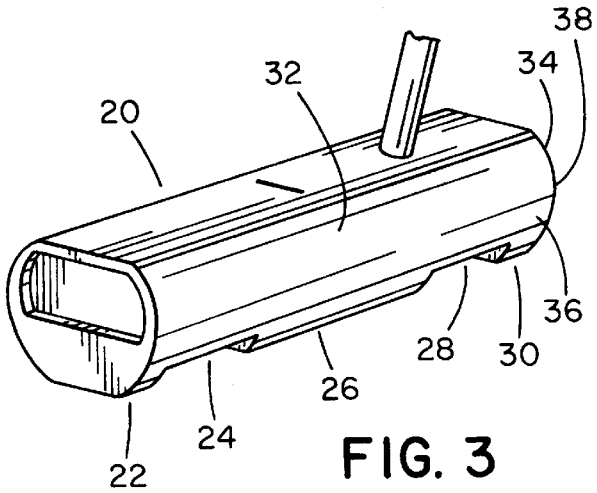
FIG. 3 is a top perspective view of a first preferred embodiment of a dual radius putter head.

FIG. 3 shows a perspective view of putter head 20. Toe portion 22, center portion 26, and heel portion 30 protrude outwardly beyond mid-toe portion 24 and mid-heel portion 28. The intersection of upper radius 34 and lower radius 36 along linear path 38 is also shown.

Figure 4:
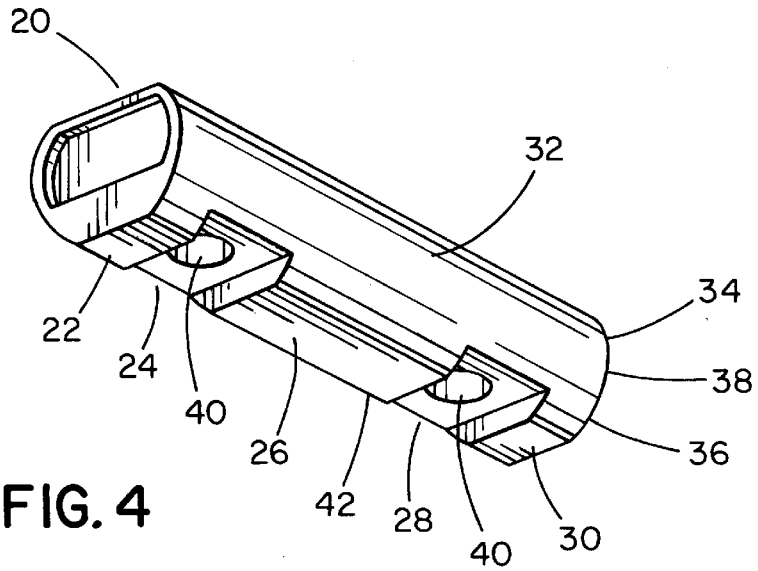
FIG. 4 is a bottom perspective view of FIG. 3, showing the first preferred embodiment.

FIG. 4 is a bottom perspective view of FIG. 3. This view shows how toe portion 22, center portion 26, and heel portion 30 extend outwardly beyond mid-toe portion 24 and mid-heel portion 28. Moreover, this view shows how front surface 32 is a convex surface consisting of upper radius 34 and lower radius 36 which meet along linear path 38, along which will eventuate a single point of contact for a golf ball. This view also shows weights 40 disposed in mid-toe portion 24 and mid-heel portion 28 to give putter head 20 a balanced feel during the engagement of a golf ball. These weights 40 are made of a substantially denser material than putter head 20 (for example, lead). In a preferred embodiment, these weights 40 are elevated above bottom surface 42 to provide a smoother stroke because the weight is not dragging along the ground. Rather, putter head 20 glides effortlessly above the putting surface providing a more fluid stroke than with previously disclosed putters.

Figure 5:
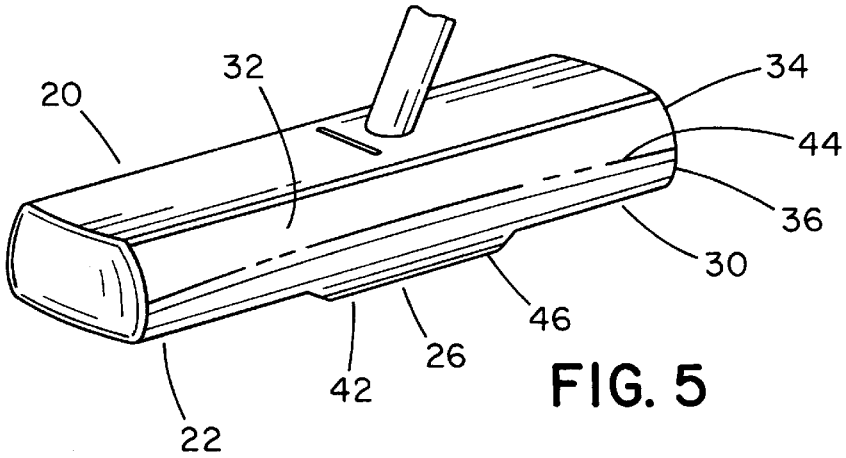
FIG. 5 is a top perspective view of a second preferred embodiment of a dual radius putter head.

FIG. 5 shows another preferred embodiment in a top perspective view. In this embodiment center portion 26 extends outwardly beyond toe portion 22 and heel portion 30. Bottom surface 42 is defined by bottom radius 46 and has a substantially convex shape. However, in this embodiment upper radius 34 and lower radius 36 meet along a substantially arcuate path as defined by path radius 44. Path radius 44 is complementary to bottom radius 46, thus providing a fine striking point along front surface 32 of putter head 20. This allows front surface 32 to consistently contact the ball at a single point regardless of the lie angle (defined as the angle created by the longitudinal orientation of the putter and the ground) of the putter created by the golfer at address. Such a scheme facilitates a large "sweet spot," defined as the area of front surface 32 optimally designed for contact with a golf ball.

Figure 6:
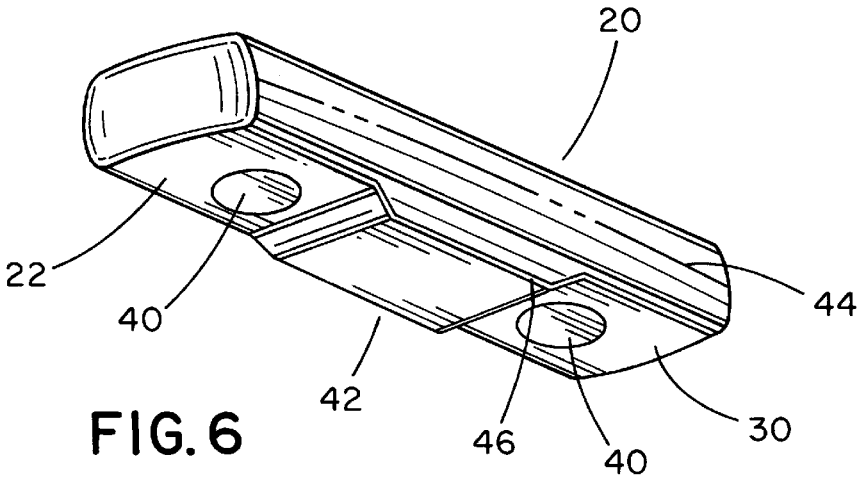
FIG. 6 is a bottom perspective view of FIG. 5, showing the second preferred embodiment.

FIG. 6 is a bottom perspective view of FIG. 5 which gives a better view of bottom surface 42. As is evident by FIG. 6 bottom radius 46 is complementary to path radius 44 in a preferred embodiment. Furthermore, FIG. 6 shows weights 40 disposed in toe portion 22 and heel portion 30. Again, weights 40 are provided so that the center of gravity of putter head 20 is at the point of impact, rather than below the point of impact, as is the case with most prior art putters.

Figure 7:
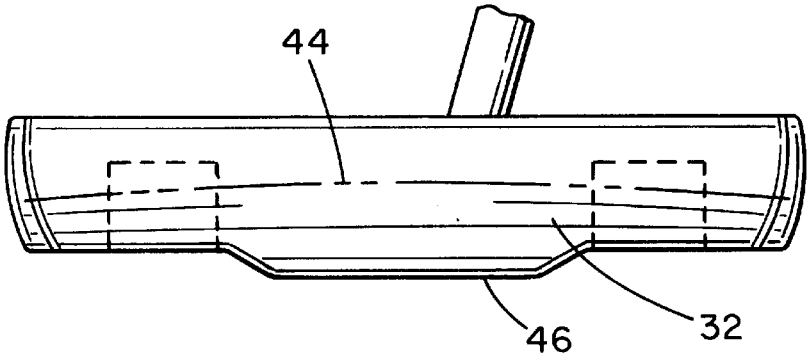
FIG. 7 is a front view of FIG. 5, showing the second preferred embodiment.

FIG. 7 is a front view of FIG. 5 showing how path radius 44 and bottom radius 46 act together to provide a large area which is geometrically designed to give a golf ball a single point of contact at address. In this way, a larger portion of front surface 32 would be considered the "sweet portion" than with prior art putters.

Figure 8:
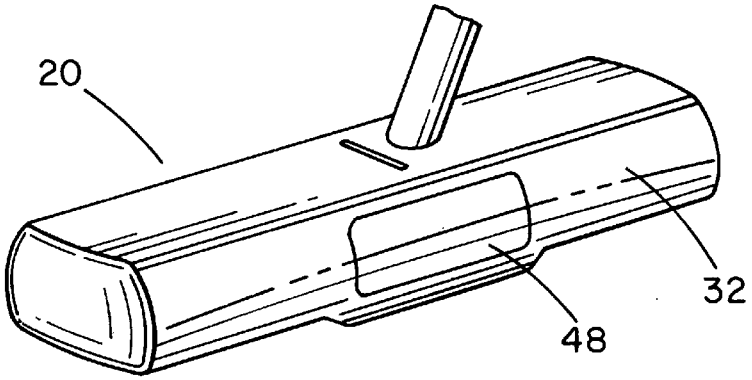
FIG. 8 is a top perspective view of a third preferred embodiment of a dual radius putter head.

FIG. 8 is a top perspective view of another preferred embodiment of the present invention. This embodiment, which has all the features described in FIG. 5 further comprises insert 48 consisting of a less dense material than that of putter head 20. For example, insert 48 could be comprised of anodized aluminum or a high-strength engineering plastic. In this preferred embodiment, insert 48 is comprised of a poured polymer which is self-adhesive and is hand-finished to comply substantially to the shape of front surface 32. Nonetheless, the insert could be made of other materials and adhered to front surface 32 by means of bolts, screws, latches, or a high-strength epoxy. Thus, the present invention has the advantage of a soft point of contact due to insert 48 as well as all the advantages as described above provided by the dual radius front surface 32.

Figure 9:
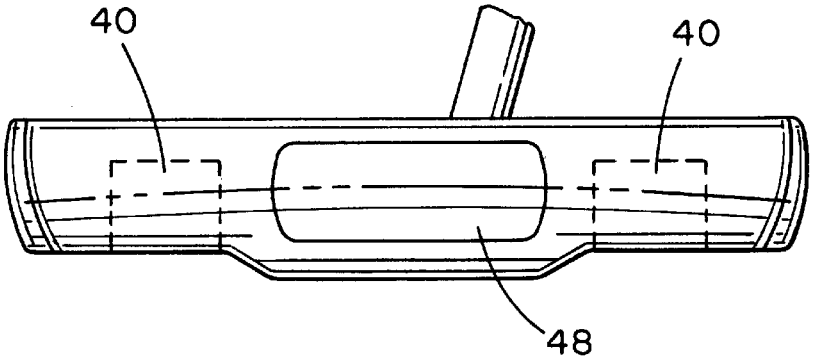
FIG. 9 is a front view of FIG. 8, showing the third preferred embodiment.

FIG. 9 is a front view of FIG. 8, which shows the position of weights 40 in the embodiment including insert 48. Again, weights 40 are provided so that the center of gravity of putter head 20 is at the point of impact with the golf ball.

Although particular embodiments of the present invention have been illustrated in the accompanying drawings and described in the foregoing detailed description, it is to be understood that the present invention is not limited to just the embodiments disclosed. Those skilled in the art will undoubtedly come up with new combinations which utilize the teachings of this disclosure; these rearrangements, modifications and substitutions are to be properly held within the scope of the claims hereinafter.

I claim:

1. A putter for putting a golf ball comprising:

a shaft with a handle end and a mounting end;

a handle secured to said handle end; and, a putter head fixably mounted to said mounting end having a front surface for engaging a golf ball, a rear surface, and a bottom surface, said front surface having a substantially convex shape defined by an upper radius and a lower radius, said upper radius being smaller than said lower radius, said upper and lower radii meeting longitudinally along a linear path on said putter head, said rear surface having toe, mid-toe, center, mid-heel, and heel portions, said toe, center, and heel portions protruding outwardly beyond said mid-toe and mid-heel portions, wherein said mid-toe and mid-heel portions are filled with weighted material having a greater density than that of said putter head.

2. The putter of claim 1 wherein said upper and lower radii meet along an arcuate path defined by a path radius.

3. The putter of claim 2 wherein said rear surface has toe and heel portions with a center portion therebetween protruding outwardly beyond said toe and heel portions, said center portion having a convex bottom surface defined by a bottom radius.

4. The putter of claim 3 wherein said path radius is complementary to said bottom radius.

5. The putter of claim 4 wherein said toe and heel portions are filled with weighted material having a greater density than that of said putter head.

6. A putter for putting a golf ball comprising:

a shaft with a handle end and a mounting end;

a handle secured to said handle end; and, a putter head fixably mounted to said mounting end having a front surface, a rear surface, and a bottom surface, said front surface having a substantially convex shape defined by an upper radius and a lower radius meeting longitudinally on said putter head, said lower radius being larger than said upper radius, and said front surface having an insert member for engaging a golf ball fittingly disposed in said front surface comprised of a material with a lower density than said putter head, said insert member conforming to said substantially convex shape of said front surface as defined by said upper radius and said lower radius.

7. The putter of claim 6 wherein said upper and lower radii meet along a linear path.

8. The putter of claim 7 wherein said rear surface has toe, mid-toe, center, mid-heel, and heel portions, said toe, center, and heel portions protruding outwardly beyond said mid-toe and mid-heel portions.

9. The putter of claim 8 wherein said mid-toe and mid-heel portions are filled with weighted material having a greater density than that of said putter head.

10. The putter of claim 6 wherein said upper and lower radii meet along an arcuate path defined by a path radius.

11. The putter of claim 10 wherein said rear surface has toe and heel portions with a center portion therebetween protruding outwardly beyond said toe and heel portions, said center portion having a convex bottom surface defined by a bottom radius.

12. The putter of claim 11 wherein said path radius is complementary to said bottom radius.

13. The putter of claim 11 wherein said toe and heel portions are filled with weighted material having a greater density than that of said putter head.

14. A putter for putting a golf ball comprising:

a shaft with a mounting end and a handle end, a handle secured to said handle end, and a putter head fixably attached to said mounting end, said putter head having a front face for engaging a golf ball, a front portion longitudinally opposed to a rear portion, and a bottom surface, said front face defined by a first radius of curvature and a second radius of curvature, said first and second radii of curvature being unequal and meeting longitudinally along an arcuate path defined by a path radius on said putter head and in a substantially smooth manner so as to produce a continuous but nonuniform convex front face, said bottom surface having a convex shape defined by a bottom radius, said bottom radius being complementary to said path radius, and said putter head having weights fixably disposed in said front and rear portions.

15. The putter of claim 14 further comprising an insert for engaging said golf ball fittingly disposed in said front face conforming to said first and second radii of curvature and having a lower material density than that of said putter head.

* * * * *